United States Patent [19]

Brill

[11] Patent Number: 5,060,949

[45] Date of Patent: Oct. 29, 1991

[54] GOLF CLUB CONSTRUCTION

[76] Inventor: Edward F. Brill, 999 E. Summit Ave., Oconomowoc, Wis. 53066

[21] Appl. No.: 321,763

[22] Filed: Mar. 10, 1989

[51] Int. Cl.[5] ..... A63B 53/04

[52] U.S. Cl. ..... 273/167 A; 273/164; 273/169; 273/167 E; 273/167 G

[58] Field of Search ..... 273/167–175, 273/164, 80.5, 80.6, 163 R, 80 C; D21/214

[56] References Cited

U.S. PATENT DOCUMENTS

| | | | |
|---|---|---|---|
| D. 181,813 | 12/1957 | Rood | 273/167 J X |
| D. 240,948 | 8/1976 | Redoutey | 273/167 A X |
| 1,139,985 | 5/1915 | Legh | 273/169 |
| 1,671,956 | 5/1928 | Sime | 273/167 A |
| 1,927,083 | 9/1933 | Davis | 273/77 A |
| 1,969,086 | 8/1934 | Luckett | 273/164 X |
| 2,784,969 | 3/1957 | Brandon | 273/167 GX |
| 3,020,048 | 2/1962 | Carroll | 273/167 G |
| 3,947,041 | 3/1976 | Barber | 273/167 G |
| 3,961,796 | 6/1976 | Thompson | 273/167 A |
| 4,632,400 | 12/1986 | Boone | 273/164 |

FOREIGN PATENT DOCUMENTS

| | | | |
|---|---|---|---|
| 480029 | 1/1952 | Canada | 273/167 E |
| 340579 | 1/1931 | United Kingdom | 273/174 |

OTHER PUBLICATIONS

"What's New in Woodheads" by Larry Dennis, as seen in *Golf Digest*, Jul. 1978, p. 32.

*Primary Examiner*—Edward M. Coven
*Assistant Examiner*—Sebastiano Passaniti
*Attorney, Agent, or Firm*—Andrus, Sceales, Starke & Sawall

[57] ABSTRACT

A golf club head and hosel construction. The head has a front face facing in the intended direction of flight of a golf ball and a sole extends rearwardly from the lower edge of the front face. The lower extremity of the front face is downwardly convex, having a central generally curved apex, and an alignment marker is disposed on the front face directly above the apex. The heel and toe portions of the rear face are provided with enlargements which border a generally vertical arched depression. The lower end of the depression terminates at the sole adjacent the lower extremity of the front face to provide a generally sharp edge capable of penetrating the turf, while the heel and toe enlargements control the penetration of the edge into the turf. The hosel which is connected to the head includes a generally sharp hosel edge facing in the direction of flight, and a generally flat surface borders the hosel edge and merges into the head. The flat surface is disposed at an acute angle with respect to the direction of flight and acts as an air foil to resist shaft deflection during swinging of the golf club.

8 Claims, 2 Drawing Sheets

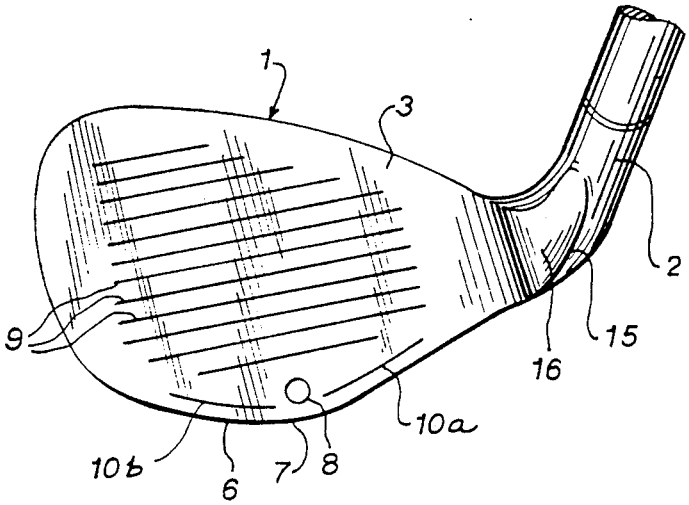
FIG. 1
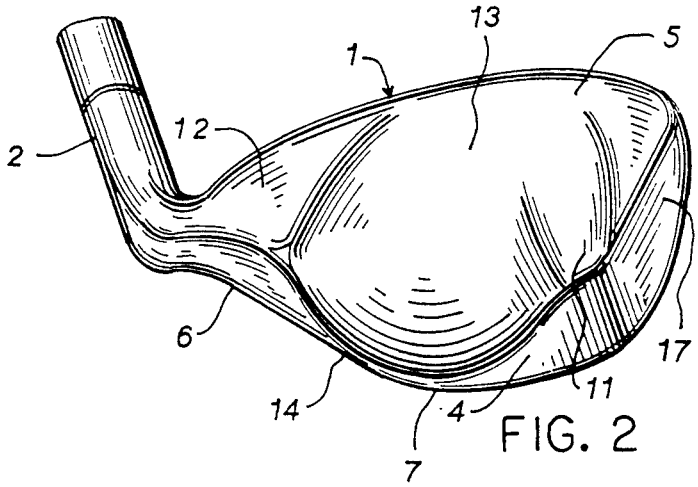
FIG. 2
FIG. 3
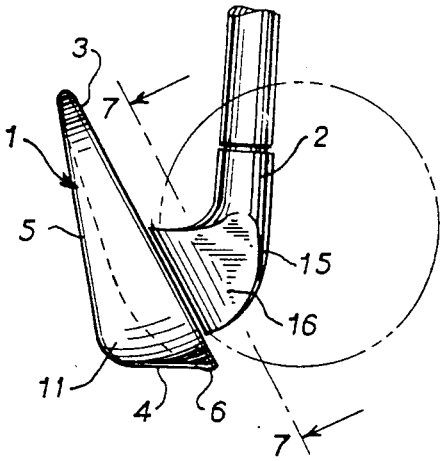
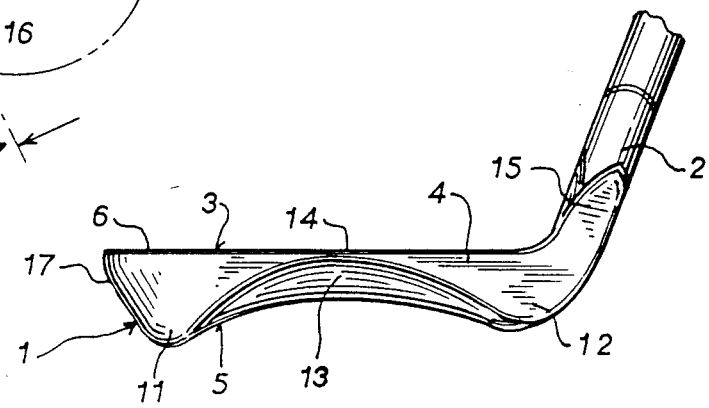
FIG. 4

FIG. 5
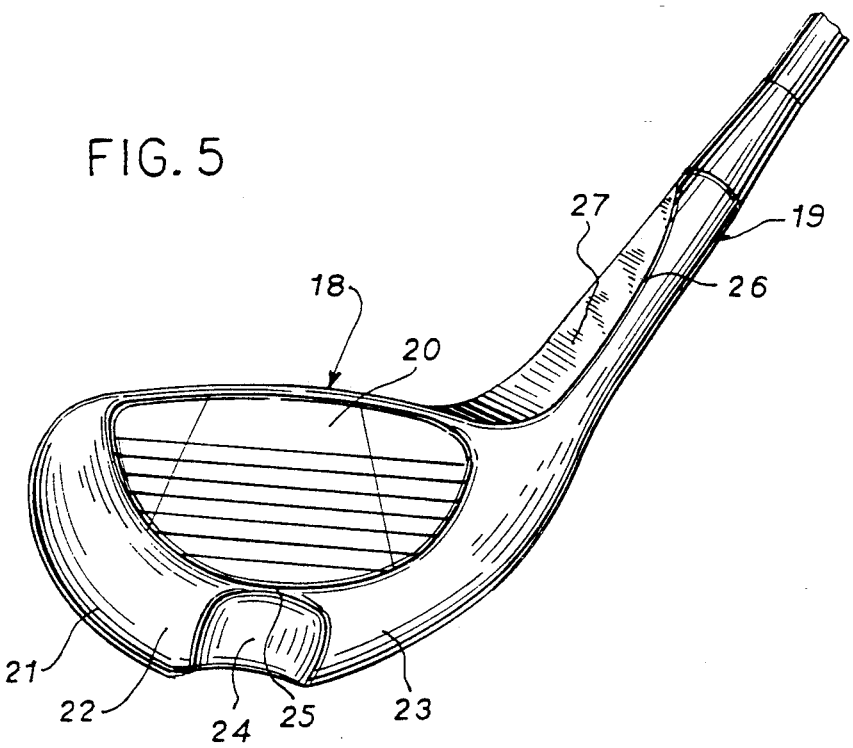
FIG. 6
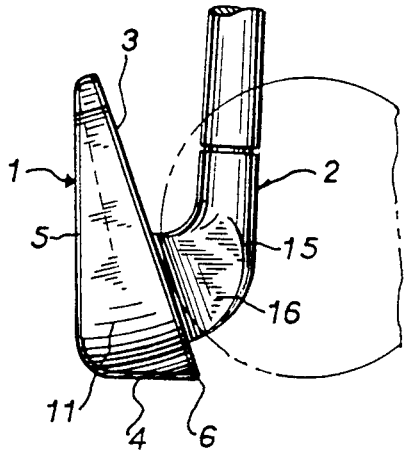
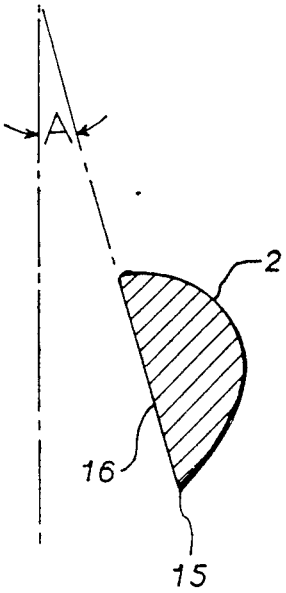
FIG. 7

GOLF CLUB CONSTRUCTION

FIELD OF THE INVENTION

The invention relates to an improved head and hosel construction for a golf club.

SUMMARY OF THE INVENTION

The invention is directed to an improved head and hosel construction for a golf club. The head, which can be formed of metal or wood, or other suitable material, has a front face facing in the intended direction of flight of the golf ball. The lower extremity or edge of the front face is defined by a pair of edge sections which are joined at a central, generally curved apex.

The rear face of the head is provided with a pair of spaced enlarged portions or projections which border a central, vertically extending arched depression that extends generally the entire height of the rear face. The lower end of the depression terminates at the sole adjacent the lower extremity of the front face to provide the central portion of the lower extremity of the front face with a generally sharp edge.

The sharp edge is adapted to penetrate the turf as the head strikes the ball and the enlarged portions on the rear face will engage the turf and control penetration of the edge into the turf.

The invention also includes a novel hosel construction, in which the hosel is provided with a generally sharpened edge which faces in the direction of flight. The hosel edge is bordered by a generally flat surface, which merges into the front face of the head. The flat surface on the hosel is located at an acute angle with respect to the direction of flight, and as the club is swung, the surface acts as an air foil to resist twisting torque and bending due to centrifugal force of the swinging head and thus acts to minimize deflection of the shaft.

As a further feature of the invention, an alignment marker, which can be in the form of a small circle, is located on the front face immediately above the apex and beneath the grooves on the face. The marker aids in aligning the ball with the center or "sweet spot" of the face, and is particularly useful when the face is open in order to generate a shot with greater loft, or when the face is closed to provide a shot with lesser loft.

Other objects and advantages will appear in the course of the following description.

DESCRIPTION OF THE DRAWINGS

The drawings illustrate the best mode presently contemplated of carrying out the invention.

In the drawings:

FIG. 1 is a front elevation of the head construction of the invention;

FIG. 2 is a perspective view of the rear face of the head;

FIG. 3 is an end view of the head with a ball shown in phantom;

FIG. 4 is a perspective view of the bottom of the head;

FIG. 5 is a perspective view of a wood incorporating the invention;

FIG. 6 is an end view of a modified form of the invention as used with a less lofted iron, such as a two iron; and FIG. 7 is a diagrammatic view taken along line 7—7 of FIG. 3 and showing the relationship of the air foil surface on the hosel to the direction of flight.

DESCRIPTION OF THE ILLUSTRATED EMBODIMENT

FIGS. 1-4 illustrate the invention as applied to a metal iron, such as a wedge. The iron includes a head 1 and a hosel 2 which is connected to the heel portion of the head.

Head 1 includes a generally flat front face 3 which is adapted to strike the ball and faces in the intended direction of flight of the ball. Head 1 also includes sole 4 and a a rear face 5.

The lower extremity or edge 6 of front face 3 is defined by a pair of edge sections which meet at a generally curved apex 7, as seen in FIG. 1. Thus, the lower edge 6 is downwardly convex.

Located directly above apex 7 is an alignment marker 8 and, as shown in the drawings, the marker 8 can take the form of a small circle. A series of generally parallel, standard-type grooves 9 are formed in the front face 3, and in addition a pair of diagonal grooves 10 are located on opposite sides of marker 8 and are generally parallel to lower edge 6.

Marker 8 aids in aligning the ball with the center or "sweet spot" on face 3 and has particular use when the club head 1 is open to provide a shot of greater loft, or when the face is closed to provide a shot of lesser loft.

Rear face 5 is formed with a pair of enlargements or projections 11 and 12 which extend to sole 4. Enlargement 11 is located adjacent the toe of the head, while enlargement 12 is located adjacent the heel and merges into the hosel 2. As best shown in FIGS. 2 and 4, the enlargements 11 and 12 are separated by a generally curved or arched depression 13 which extends substantially the full height of the head. The lower end of depression 13 terminates at sole 4 adjacent lower edge 6 so that the central portion 14 of lower edge 6 is relatively sharp.

As the club head 1 strikes the ball, edge portion 14 will initally penetrate the turf and subsequently the enlargements 11 and 12 will contact the turf. Due to the rounded enlarged nature of portions 11 and 12, they will limit the penetration of edge 6 and control the divot.

Portions 11 and 12 being located adjacent the toe and heel, respectively, provide perimeter weighting for the club head and enlarge the "sweet spot".

The invention also provides a novel hosel design, in which the hosel 2 is provided with a generally sharp edge 15, which faces generally in the direction of flight of the ball. Edge 15 is bordered by a generally flat surface 16, which merges into front face 3 of head 1. Edge 15 is located at an acute angle A of about 2° to 15° with respect to the intended line of flight of the ball, as shown in the schematic drawing of FIG. 7, and as the club is swung, surface 16 acts as an air foil to resist twisting torque and bending due to the centrifugal force of the swinging head. During the swinging action, the center of gravity of the head is offset from the center line of the shaft which results in a moment acting to deflect the shaft. The surface 16 will act as an air foil to balance the moment and minimize shaft deflection.

In addition, edge 15, being relatively sharp, will aid in moving the hosel through long grass or other vegetation.

The blunt peripheral edge 17 on the toe acts to keep the club head on a swing plane during the golf swing.

FIG. 5 shows the invention as applied to a wood including a wooden head 18 and a hosel 19. Head 18 is provided with a front face 20 and a lower face or sole 21 extends rearwardly from the lower edge of front face 20. As shown in FIG. 5, sole 21 is provided with a pair of spaced enlargements or projections 22 and 23, which are located adjacent the toe and heel respectively of head 18. Enlargements 22 and 23 are separated by a generally curved depression 24, which extends the full front-to-rear length of the sole. The forward end of depression 24 is joined to front face 20 along an edge 25 and the edge, being relatively sharp, will aid in moving the ball out of a close lie or divot, while the enlargements 22 and 23 will limit the penetration of edge 25 into the turf.

As in the case of the embodiment of FIGS. 1–4, the hosel 19 is provided with a relatively sharp edge 26 facing forwardly in the direction of flight of the ball, and edge 26 is bordered by a generally flat surface 27 which merges with head 18. Edge 26 and surface 27 are similar in construction and function to hosel edge 15 and surface 16, previously described.

FIG. 6 illustrates the invention as applied to a less lofted iron, such as a two iron.

Various modes of carrying out the invention are contemplated as being within the scope of the following claims particularly pointing out and distinctly claiming the subject matter which is regarded as the invention.

I claim:

1. A golf club construction, comprising a head having a front face facing in the intended direction of flight of a ball and having a sole and a rear face, said front face having a downwardly convex lower extremity terminating at a central generally curved apex, the central portion of said rear face being convex in an upward direction and said rear face having a pair of spaced enlarged side portions located adjacent the heel and toe, respectively, of the head, the area of said rear face between said enlarged side portions being generally concave in a heel-to-toe direction, the lower end of said area terminating at said sole adjacent said lower extremity to provide a generally sharp edge, said enlarged portions terminating at said sole on either side of said apex, said sharp edge aiding in penetrating the head into the turf and said enlarged portions acting to control the penetration of said edge.

2. The construction of claim 1, in which said lower extremity is defined by a pair of generally straight sections joined at said central generally curved apex.

3. The construction of claim 2, and including alignment means located on said front face immediately above said apex.

4. The construction of claim 1, and including a hosel connected to the heel end of said head, said hosel having a generally sharp hosel edge facing generally in said direction of flight.

5. The construction of claim 4, wherein said hosel includes a generally flat surface bordering said hosel edge and located adjacent said head.

6. The construction of claim 5, wherein said surface is disposed at an angle of about 5° to 15° with respect to said direction of flight.

7. The construction of claim 3, and including a series of first generally parallel horizontal grooves formed in said front face.

8. The construction of claim 7, and including a pair of second grooves, said second grooves straddling said alignment means and disposed generally parallel to said lower extremity and disposed at an acute angle to said first grooves.

* * * * *